United States Patent [19]

Biesenthal

[11] Patent Number: 4,738,053

[45] Date of Patent: Apr. 19, 1988

[54] PORTABLE ENVIRONMENTAL BARRIER FOR AN OPEN DOOR-WAY OR WINDOW

[76] Inventor: Wallis G. Biesenthal, R.R. #7, Springfield, Ill. 62707

[21] Appl. No.: 924,396

[22] Filed: Oct. 29, 1986

[51] Int. Cl.[4] ..... E06B 7/00

[52] U.S. Cl. ..... 49/70; 160/88

[58] Field of Search ..... 49/70, 163, 169, 48, 49/58, 49, 54, 50; 160/88, 180

[56] References Cited

U.S. PATENT DOCUMENTS

| | | | |
|---|---|---|---|
| 538,538 | 4/1895 | Schreiner | 49/58 |
| 827,483 | 7/1906 | Voorhees | 160/88 X |
| 1,643,939 | 10/1927 | Becker | 49/48 X |
| 1,745,299 | 1/1930 | Holan | 160/88 |
| 2,222,753 | 11/1940 | Persson | 160/88 |
| 2,914,818 | 12/1959 | Pritzert | 49/70 |
| 4,022,263 | 5/1977 | Beckett et al. | 160/180 X |

*Primary Examiner*—Philip C. Kannan

*Attorney, Agent, or Firm*—Edwin E. Greigg

[57] ABSTRACT

An environmental barrier device which fits between an open door of a building and the door jamb in order to enclose the open space therebetween and through which hoses, electrical wires, tubing, piping, etc., may pass. The device allows access to and egress from the building while in use and yet seals the open space against loss of heat or coolant, and also prevents pets, insects, or the like from passing through the open space during the time the door is necessarily open.

15 Claims, 2 Drawing Sheets

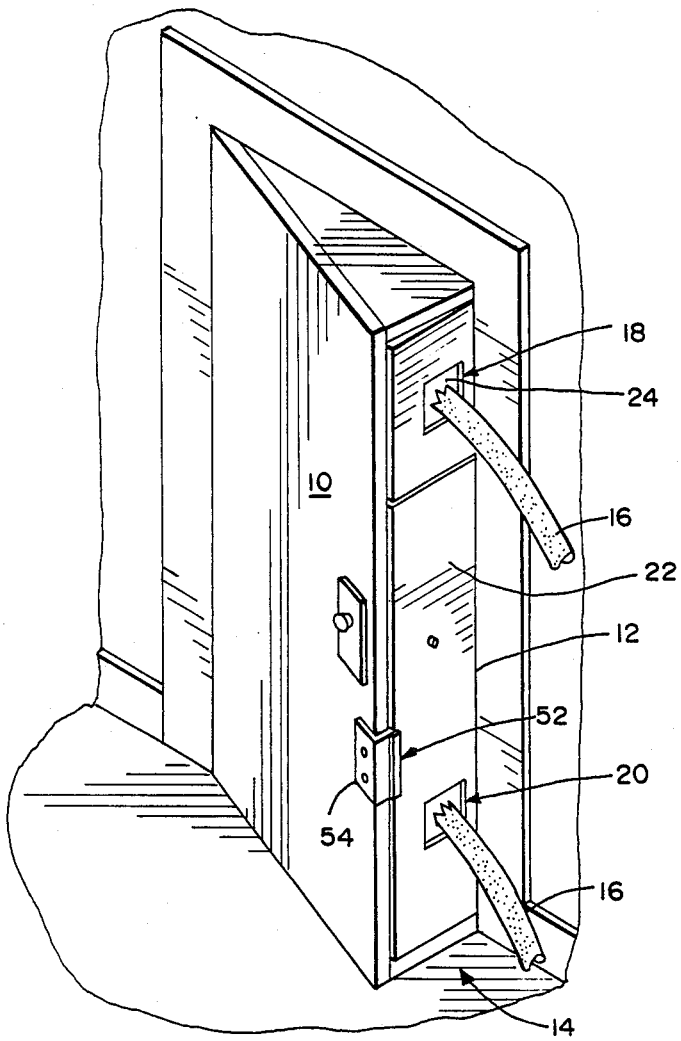
FIG 1
FIG 2
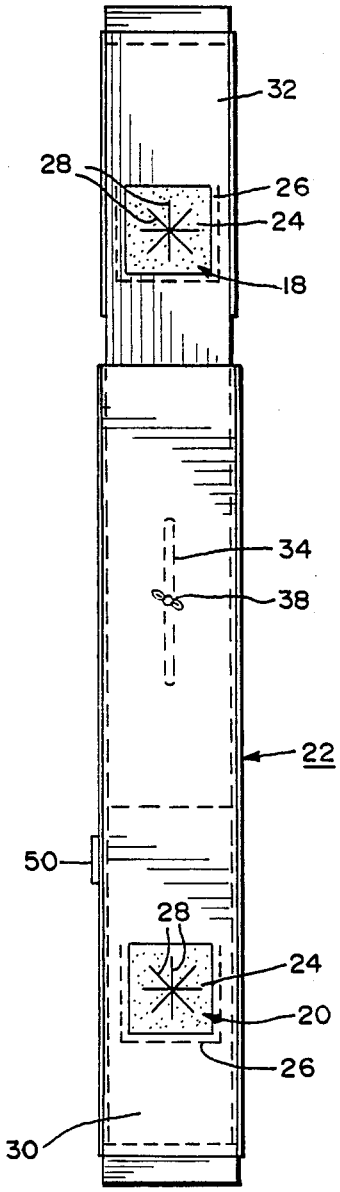

PORTABLE ENVIRONMENTAL BARRIER FOR AN OPEN DOOR-WAY OR WINDOW

This invention is directed to a device called a "Jiffy Jamb" through which hoses, electrical wires, tubing, piping, etc., may be passed from outside a building to the inside thereof by use of an open window or door. More particularly, the device is so constructed as to close the spacing between the open door and the door jamb as well as between an open window and the window frame.

Heretofore, hoses have passed through the spacing of open doors and windows without any protection against the loss of heat or air conditioning as well as the passage of pets and unwanted insects, etc.

This device overcomes problems created by passage of hoses through open doors and hinged windows by using a structure which fits snugly between the open door or hinged open window in order to close off the spacing formed by the open door or hinged open window.

OBJECT AND SUMMARY OF THE INVENTION

In the disclosure, the description will be discussed relative to an open door whereas the same structural arrangement will be used for a hinged open window.

It is therefore an object of this invention to provide a structure which will close off the spacing between an open door and the door jamb and through which hoses and the like may be passed with little loss of ambient indoor heat or air conditioning.

Another object is to provide a structure for an open door of a building through which hoses may pass an open doorway which will permit entry and exit through the door without disturbing the structure.

Still another object is to provide a structure through which hoses may pass into a building which structure will confine pets within the building as well as prevent entry of unwanted animals, insects, dust, and other debris, etc.

Further objects and advantages of this invention will become apparent from the following detailed description when considered with the drawings wherein:

BRIEF DESCRIPTION OF THE DRAWINGS

FIG. 1 is a perspective view illustrating the Jiffy Jamb device secured in place between an open door and the door jamb;

FIG. 2 is a view of the end panel;

DETAILED DESCRIPTION

Figure 3:
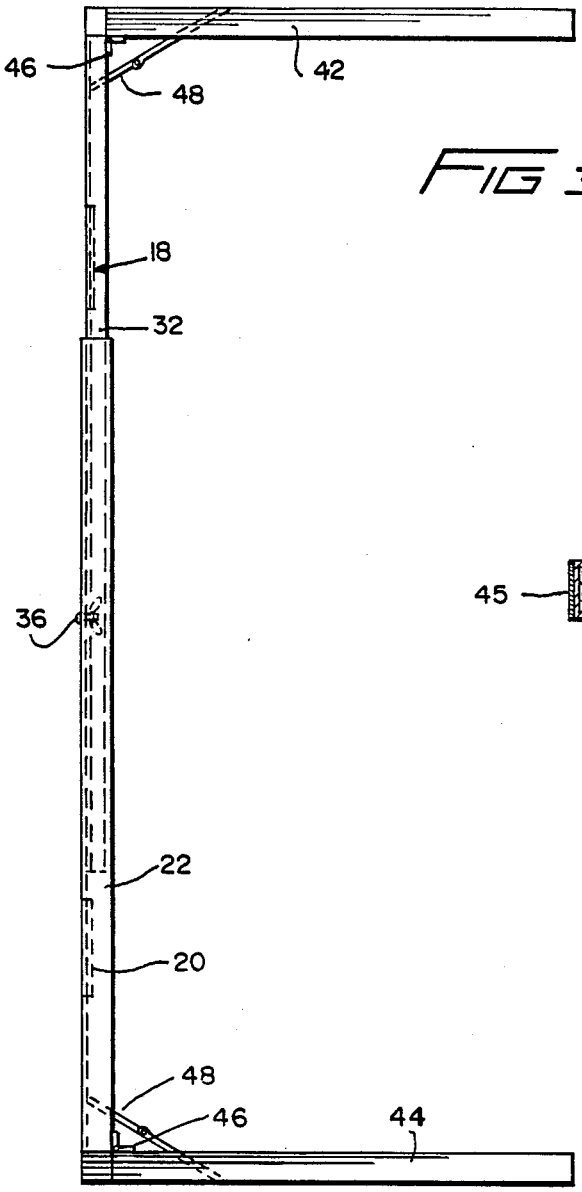
FIG. 3 is a side view of the Jiffy Jamb device.
Figure 5:
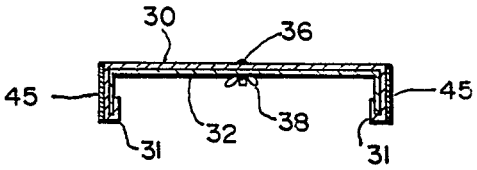
FIG. 5 is a cross-sectional view along line 5—5 of the end panel illustrating the expandable sections of the end panel.
Figure 4:
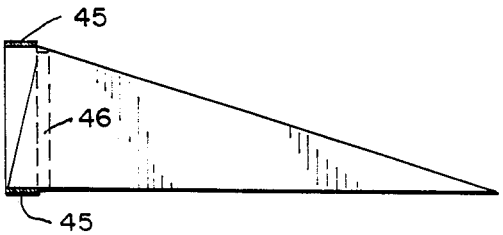
FIG. 4 is a top view of the lower side panel.

Now referring to the drawing, there is shown for illustrative purpose a Jiffy Jamb barrier device made in accordance with this invention. FIG. 1 is a perspective view of the Jiffy Jamb device as secured in an open doorway of an entrance to a room of a building. The Jiffy Jamb device is secured between the open door 10 and the jamb 12 which closes the normally open space 14 for entry of hoses 16 for cleaning carpets, walls, etc. The hoses are admitted through access openings 18, 20 in the end panel 22. Each of the openings 18, 20 are provided with a flexible material 24 such as rubber sheeting surrounded by a frame 26 such as metal which holds the flexible material in place. The flexible material is provided with apertures 28 through which the hose may pass and which will close tightly about the hose. In a preferred embodiment, the end panel is formed by two U-shaped panels 30, 32 with the panels 30 having rebent ends that form a track 31 in which the panel 32 slides for extension of the length of the panel. The end panel 32 is provided with a central slot 34 through which a bolt 36 secured to the panel 30 passes. A wing nut 38 is threaded onto bolt 36 for tightening against the end panel 32 to secure the end panel 32 in place relative to end panel 30. The end panel 32 and the slot 34 are shown in dotted line in FIG. 2.

The outer sides of the end panels 30, 32 may be covered with a foam padding 45 in order to prevent damage to the face of the door and jamb.

The upper and lower panels 42, 44 are each formed in a triangular shape and secured, either permanently or removably, to the top and bottom ends of the end panel. A preferred embodiment provides for the use of hinges 46, such as a piano hinge, and self-locking spring hinges, arms or buttresses 48 provided between the end panel and the upper and lower panels for folding the upper and lower panels alongside the end panel for storage conveniently when not in use. When in use the upper and lower panels close off the spacing along the top and bottom of the door, as shown in FIG. 1.

In order to retain the door in a closed position against the Jiffy Jamb device, a securing means comprising, for instance, magnetic material 50 may be secured along an edge of the end panel and a magnet 52 may be secured to an angular element 54 which fits along the door. Alternatively, hook and loop fasteners could be applied to the door and the device. In the preferred embodiment, the magnet and magnetic material 50 will attract each other and the angular element 54 will secure the door in place. By the use of these retention means, i.e., magnets or hook and loop fasteners, the door may be easily opened and closed to allow access to and agress from the building.

The end panel may be made with virtually any desired width, but preferably a width of 10 inches, and a height which is adjustable for different height doors by extending the panel 32 relative to the panel 30. The upper and lower panels 42 and 44 will have the same width as the end panel at their connection with one side tapering to the other side toward the door hinge to form an angular piece that fits between the door and the header. The end panel fits between the door and the sill.

As set forth above, the Jiffy Jamb barrier device as described for a door may be used with similar construction for a hinged window. The Jiffy Jamb barrier device can be made to fit end-hinged or side-hinged windows that open outwardly or inwardly similar to a door.

The Jiffy Jamb barrier device may be made of rigid materials, such as sheet metal, fiberglass, wood, plastics, or materials with like characteristics, which can be easily formed with a guide rail for adjusting the end panels 30 and 32 without departing from the teaching of the invention.

As an example of use such as for cleaning rugs within a building, the Jiffy Jamb barrier device is placed between an open door with the end panel extending from the bottom to the top of the opening between the door and the vertical jamb. The upper and lower panels are opened and interfit between the door and the header and sill. A feed hose is extended from the equipment placed exteriorly of the building through an access opening in the end panel and to the work area within the building. A return hose is extended from the work area through a second access opening in the end panel to the equipment outside of the building. Thus the hoses pass through the end panel, and the end panel and upper and lower ends close-off the spacing between the open door and the door jamb. Since the Jiffy Jamb barrier device is not permanently secured to the open door, the door may be opened for egress and access to the building by occupants and the work crew. Thus the Jiffy Jamb barrier device will prevent loss of heat or coolant, will confine small children and pets, and will prevent undesired outside elements from entry through the spacing between the open door and the door jamb.

The above also applies to a hinged window which may be opened for placement of a Jiffy Jamb barrier device for passage of hoses, etc., through the open window.

The foregoing relates to preferred exemplary embodiments of the invention, it being understood that other variants and embodiments thereof are possible within the spirit and scope of the invention, the latter being defined by the appended claims.

What is claimed to be desired by Letters Patent of the United States is:

1. A device for closing a spacing between an open door or open hinged window of a building to permit passage of desired objects between said device and said door while permitting passage of at least one object through said device and to prevent passage between said door and said device as well as through said device of undesired objects, said device comprising an end panel provided with upper and lower panels secured to opposite ends thereof, said end, upper and lower panels being adapted to fit between said open door, a header, sill and jamb associated therewith, said end panel including at least one access opening therein through which a desired work piece of a smaller size can be admitted from outside said building to an inside area thereof whereby said device prevents passage of undesired objects through said device.

2. A device as set forth in claim 1, wherein said upper and lower panels are triangular in form and each is secured along a base portion thereof to said ends of said end panel.

3. A device as set forth in claim 1, in which said at least one access opening includes means defining a flexible aperture, said flexible aperture forming a reception opening for differently sized elongated work pieces, said reception opening being adapted to fit snugly against said elongated work piece.

4. A device as set forth in claim 1, wherein said end panel and said upper and lower panels include a padding material on sides thereof to protect the door and jamb from damage due to placement of said device between said door and said door jamb.

5. A device as set forth in claim 1, wherein said end panel is formed by first and second end panels, said first end panel including a guide channel in which said second end panel is adjustable relative to said first end panel.

6. A device as set forth in claim 5, wherein said end panel and said upper and lower panels include a padding material on sides thereof to protect the door and jamb from damage due to placement of said device between said door and said door jamb.

7. A device as set forth in claim 5, in which said at least one access opening includes means defining a flexible aperture, said flexible aperture forming a reception opening for differently sized elongated work pieces, said reception opening being adapted to fit snugly against said elongated work piece.

8. A device as claimed in claim 7, in which said at least one access opening comprises a flexible aperture in each of said first and second end panels each of which flexible apertures comprise a pierced covering of flexible material for passage of an elongated work piece such as a hose.

9. A device as claimed in claim 8, in which said first and second end panels include an adjusting means for adjusting said second end panel relative to said first end panel.

10. A device as set forth in claim 9, wherein said end panel and said upper and lower panels include a padding material on sides thereof to protect the door and jamb from damage due to placement of said device between said door and said door jamb.

11. A device as claimed in claim 1, which includes a securing means for securing said open door to said end panel.

12. A device as set forth in claim 11, wherein said end panel and said upper and lower panels include a padding material on sides thereof to protect the door and jamb from damage due to placement of said device between said door and said door jamb.

13. A device as claimed in claim 11, in which said securing means for securing said open door to said end panel comprises magnetic means.

14. A device as claimed in claim 13, in which said magnetic means includes a ferrous element secured to said end panel, and a magnetic element related to said door.

15. A device as set forth in claim 14, wherein said end panel and said upper and lower panels include a padding material on sides thereof to protect the door and jamb from damage due to placement of said device between said door and said door jamb.

* * * * *